US009533194B2

(12) United States Patent
Hwang et al.

(10) Patent No.: US 9,533,194 B2
(45) Date of Patent: Jan. 3, 2017

(54) GOLF BALL

(71) Applicant: VOLVIK INC., Eumseong-gun, Chungchengbuk-do (KR)

(72) Inventors: In Hong Hwang, Namyangju-si (KR); Kyung Ahn Moon, Seoul (KR)

(73) Assignee: VOLVIK INC., Eumseong-gun, Chungchengbuk-do (KR)

( * ) Notice: Subject to any disclaimer, the term of this patent is extended or adjusted under 35 U.S.C. 154(b) by 0 days.

(21) Appl. No.: 14/193,021

(22) Filed: Feb. 28, 2014

(65) Prior Publication Data

US 2015/0105181 A1 Apr. 16, 2015

(30) Foreign Application Priority Data

Oct. 16, 2013 (KR) ..... 10-2013-0123389

(51) Int. Cl.
*A63B 37/00* (2006.01)

(52) U.S. Cl.
CPC ..... *A63B 37/0006* (2013.01); *A63B 37/002* (2013.01); *A63B 37/0003* (2013.01); *A63B 37/0019* (2013.01)

(58) Field of Classification Search
CPC ..... A63B 37/12; A63B 37/14; A63B 37/0006; A63B 37/002; E04B 37/03
USPC ..... 473/378–384, 351, 374, 377
See application file for complete search history.

(56) References Cited

U.S. PATENT DOCUMENTS

| | | | | |
|---|---|---|---|---|
| 4,946,167 | A * | 8/1990 | Yamada | A63B 37/0004 473/384 |
| 5,024,444 | A | 6/1991 | Yamagishi et al. | |
| 5,564,708 | A | 10/1996 | Hwang | |
| 5,575,477 | A | 11/1996 | Hwang | |
| 5,709,618 | A * | 1/1998 | Hwang | 473/382 |
| 6,358,161 | B1 * | 3/2002 | Aoyama | 473/383 |
| 6,450,902 | B1 | 9/2002 | Hwang | |
| 6,908,403 | B1 * | 6/2005 | Hwang | 473/383 |
| 2003/0045379 | A1 * | 3/2003 | Sajima | A63B 37/0004 473/378 |
| 2005/0009643 | A1 * | 1/2005 | Sato et al. | 473/378 |
| 2008/0220907 | A1 * | 9/2008 | Aoyama et al. | 473/383 |

FOREIGN PATENT DOCUMENTS

| | | | |
|---|---|---|---|
| KR | 10-0182100 | B1 | 12/1998 |
| KR | 10-2002-0070259 | A | 9/2002 |
| KR | 10-2006-0120897 | A | 11/2006 |
| KR | 10-2001-0097085 | A | 11/2011 |

* cited by examiner

*Primary Examiner* — John E Simms, Jr.

(74) *Attorney, Agent, or Firm* — Paratus Law Group, PLLC

(57) ABSTRACT

Disclosed is a golf ball in which a plurality of dimples is arranged. The golf ball includes first dimples having the largest diameter and second dimples having the second largest diameter arranged on the surface of the golf ball divided into a spherical rhombic dodecahedron, the first dimples are arranged in an LF region of a radius of π/10 radian ±10% around a first apex of the spherical rhombic dodecahedron, shared jointly by 4 spherical rhombi, and the second dimples are arranged in an LS region of a radius of π/20 radian ±10% around a second apex of the spherical rhombic dodecahedron, shared jointly by 3 spherical rhombi. Thereby, air flow and pressure drag are uniformized in all of spherical polygons and thus, a carry distance of the golf ball may be improved.

8 Claims, 3 Drawing Sheets

GOLF BALL

CROSS REFERENCE TO PRIOR APPLICATION

The present application claims priority under 35 U.S.C. §119 to Korean Patent Application No. 10-2013-0123389 (filed on Oct. 16, 2013), which is hereby incorporated by reference in its entirety.

BACKGROUND OF THE INVENTION

Field of the Invention

The present invention relates to a golf ball, and more particularly to a golf ball capable of improving a carry distance.

Description of the Related Art

Generally, dimple arrangement of a golf ball has a great influence on flight performance of the golf ball. Specifically, when a golfer hit a golf ball with a golf club, back spin is generated by the loft angle of the golf club, at the same time strong repulsive elasticity is generated from the core of the golf ball and launching the ball, thus the golf ball flies while forming various type ballistic trajectories depending on specifications of the golf ball.

If a golfer hit a golf ball with a driver, the flight duration of the golf ball is about 6 seconds. Although the ballistic trajectory of the golf ball at the initial stage is similar, the peak of the ballistic trajectory is considerably different according to dimples of the golf balls. Of course, even if the same golfer hit a golf ball using the same golf club, flight characteristics of the golf ball is different due to differences in repulsive elasticity, hardness and rotating performance of the golf ball, the flight characteristics and the flying trajectory of the golf ball are also various according to size, number, area ratio, depth, arrangement of dimples, and so on.

Further, divisional composition used when dimples are arranged is a very important factor determining the size and area ratio of the dimples in connection with symmetry of a golf ball. Generally, divisional composition to arrange dimples on the surface of a golf ball serves to divide a sphere into a spherical polyhedral state. That is, as divisional composition, there are a spherical tetrahedron composed of 4 spherical triangles, a spherical hexahedron composed of 6 spherical squares, a spherical octahedron composed of 8 spherical triangles, a spherical cube-octahedron composed of 6 spherical squares and 8 spherical triangles, a spherical dodecahedron composed of 12 spherical pentagons, a spherical icosahedron composed of 20 spherical triangles, a spherical icosi-dodecahedron composed of 12 spherical pentagons and 20 spherical triangles, and so on. They may be subdivided and thus form spherical polyhedron of various shapes and then, dimples may be arranged.

For example, U.S. Pat. No. 5,575,477 discloses a golf ball in which, in arrangement of dimples on its spherical surface divided into faces of an icosi-dodecahedron, balance is achieved between the dimple-free area ratio of equatorial region (mold parting line), generated by buffing, and the dimple-free area ratio of the polar regions, generated by widely arranging dimples by new composition, so as to promote flight stability and to improve the carry distance of the golf ball. However, the disclosed golf ball has excellent flight stability but has disadvantages, such as increase in flight duration and difficulty in raising a ballistic trajectory peak.

And U.S. Pat. No. 5,564,708 discloses a golf ball in which the largest dimple is arranged respectively to apex portion of spherical triangle forming an octahedron and apex of small spherical triangle (one small spherical triangle in a spherical cube-octahedron) formed by connecting midpoint of each side of large spherical triangle one another, so that large and small dimples being arranged on each polygon are balanced to uniform air resistance and thus, flight stability of the golf ball is improved.

Further, U.S. Pat. No. 5,024,444 discloses a golf ball in which three or four kinds of dimples are arranged on the surface of the golf ball, and the carry distance of the golf ball is increased by properly adjusting a ratio between diameters of the dimples and depths of the dimples by adjusting the depths of the dimples according to the diameters of the dimples.

Meanwhile, U.S. Pat. No. 6,450,902 discloses a dimple arrangement of a golf ball in which conventional divisional composition of a spherical cube-octahedron is further subdivided such that dimples in regions are connected to the largest size dimples which exist one by one in the regions in a form of band and thus, a region of an air stream reducing air resistance in a low-speed area is provided so as to increase the carry distance of the golf ball.

Even in case of other documents than the above-described Patents, dimples are generally arranged in order in consideration of the sizes of the dimples so as to achieve symmetrical divisional composition and uniform arrangement of the dimples.

In this case, when hit a golf ball with a golf club, back spin is similarly generated by the loft angle of the head of the golf club. In this way, air pressure is accumulated below the reversed rotating ball, and air above the golf ball flows faster than peripheral air and thus air pressure above the golf ball is lowered. Consequently, aerodynamic lift equivalent to many times of gravity is formed on the golf ball. Thereafter, the golf ball flies at a high speed up to the apex of a ballistic trajectory with the aid of repulsive power to hitting power and aerodynamic lift, and flies at a low speed from the apex of the ballistic trajectory to a landing point. Therefore, if the time taken for a golf ball to reach the apex of the ballistic trajectory is further increased or the apex is further raised even when the golf ball flies along a proper trajectory for the same time, the carry distance of the golf ball may be further increased based on the principle of parabolic motion.

However, since air resistance of the golf ball increases in proportion to the maximum sectional area of the golf ball, decrease in size of the golf ball is advantageous in terms of the carry distance. However, the sizes of golf balls are restricted to 1.68 inches or more by the official ball regulations of R&A or USGA and thus, the sizes of golf balls should not be discretionally adjusted.

Therefore, most authorized golf balls are about 1.68 inches in diameter, the surfaces areas of the golf balls according to diameters thereof are similar and thus, if dimples are arranged by dividing the surfaces of a sphere—into the above-described spherical polyhedrons, the spherical polyhedrons are indispensably overlapped.

In general, in manufacture of a golf ball, if a cavity inserted into a mold is manufactured, a master mold is firstly made and then covered with a stainless steel plate having a thickness of 0.8 mm or less, and dimples are formed respectively by pressing using high-pressure pins. In this case, the depth of the dimples is restricted to some degree by the diameter of the dimples due to strength of the stainless steel plate. If such a depth is converted into a Frustum depth and thus, a volume ratio of the dimples is calculated, the volume ratio of dimples in most golf balls are about 400 $mm^3 \pm 10\%$. Accordingly, in case of dimples formed in such a cavity, the diameters of the dimples are determined, the volume ratio of the dimples become almost similar, flying characteristics of a golf ball are determined by the sizes and the number of respective dimples. Furthermore, when dimples are arranged, the maximum number of dimples generally fills on the surface of a sphere, a dimple area ratio tends to be determined by the diameters and the number of the dimples. It may support explanation that, if the total number of dimples having similar sizes is the same, the flying performances of golf balls become similar in terms of dimple arrangement determining the carry distance of the golf ball aerodynamically.

Of course, even if a golf ball has the same dimple arrangement, the flying performance of the golf ball differs from that of other golf balls due to differences in the structure, size, weight, and the compression of a golf ball, a material and hardness of a cover, and a degree of repulsive elasticity of a core. However, if dimple arrangements having symmetry according to the official ball regulations of R&A or USGA are formed by equalizing structures, sizes, weight, and hardnesses of golf balls, and cover materials and uniformizing the total numbers of dimples having similar sizes, when the golf balls manufactured having different dimple arrangements are hit by a swing machine and tracked using a track-man or through other measurement methods, the flying performances of the golf balls are not significantly different.

The important factors in the flying performance of a golf ball are carry distance, amount of rotation, flight duration, peak height, and lateral deviation. If two golf balls having 3~6 kinds of dimples of different sizes, which are arranged in the same numbers, have different dimple arrangements according to dimple size, the peak heights and the lateral deviations of the two golf balls are different due to a difference of the dimple arrangements.

Meanwhile, a golf ball needs to have symmetry according to the official ball regulations, that is why the same dimples are arranged on the same spherical polygons so that the surface of a sphere is symmetrically divided into a spherical polyhedron consisting of a plurality of spherical polygons. In this case, if the surface areas of the spherical polygons forming the spherical polyhedron are the same, there is no difference between dimple arrangements and a difference between flying performances is restricted. However, in many cases, the surface areas of spherical polygons formed according to divisional composition are greatly different, thus causing difficulty in dimple arrangement.

For example, if the radius of a golf ball is 0.84 inches, the overall surface area of the golf ball is 8.866831105 $in^2$. In case of a spherical rhombic dodecahedron, 12 spherical rhombi, each of which has a surface area of 0.738902592 $in^2$, form the overall surface area of a sphere. However, in case of a spherical cube-octahedron, the surface area of one of spherical triangles forming the spherical cube-octahedron is 0.388987121 $in^2$ and the surface area of one of spherical squares forming the spherical cube-octahedron is 0.959155691 $in^2$, and 8 spherical triangles and 6 spherical squares form the overall surface area of a sphere divided into the spherical cube-octahedron. Further, in case of a sphere of a spherical icosi-dodecahedron having the same radius, the surface area of one of spherical pentagons is 0.527394879 $in^2$, the surface of one of spherical triangles is 0.126904631 $in^2$, and 12 spherical pentagons and 20 spherical triangles form the overall surface area of the sphere. In this way, the respective spherical polygons are different and thus, the surface areas thereof are different. If a dimple arrangement in which only 1 kind of relatively large dimples having a diameter 0.145 inches or more to easily obtain the aerodynamic lift are symmetrically arranged on the overall surface of a sphere is given, an excessively large number of land regions without dimples is formed, the total area ratio of the dimples is reduced and thus, aerodynamic lift is reduced and an expected carry distance of the golf ball may not be obtained. On the other hand, if a dimple arrangement in which only small dimples having a diameter 0.1 inches or less are symmetrically arranged on the overall surface of a sphere is given, a serious problem in aerodynamic lift is generated and thus, only about 85% of a desired carry distance of the golf ball may be acquired.

Therefore, in order to solve the above-described problems, a dimple arrangement, in which various kinds of dimples having different sizes are arranged on the surface of a golf ball so as to minimize regions without dimples, retain lateral symmetry, and promote flight stability of the golf ball, has been required.

SUMMARY OF THE INVENTION

Therefore, the present invention has been made in view of the above problems, and it is an object of the present invention to provide a golf ball in which pressure drag due to air at any of respective positions throughout the entirety of the golf ball is uniform so as to maximize flying characteristics of the golf ball.

In accordance with the present invention, the above and other objects can be accomplished by the provision of a golf ball in which a plurality of dimples is arranged, comprising first dimples having the largest diameter and second dimples having the second largest diameter arranged on the surface of the golf ball divided into a spherical rhombic dodecahedron, wherein the first dimples are arranged in an LF region of a radius of $\pi/10$ radian±10% around a first apex of the spherical rhombic dodecahedron, shared jointly by 4 spherical rhomi, and the second dimples are arranged in an LS region of a radius of $\pi/20$ radian±10% around a second apex of the spherical rhombic dodecahedron, shared jointly by 3 spherical rhombi.

The first dimples may be arranged within the LF region, or some of the first dimples may be placed over the boundary line of the LF region such that at least half the first dimple is arranged within the LF region, and third dimples having the third largest diameter, fourth dimples having the fourth largest diameter, and fifth dimples having the fifth largest diameter may be sequentially arranged around the first dimples.

Further, the second dimples may be arranged such that the middle portion of the second dimple corresponding to half the diameter of the second dimple is placed over the boundary line of the LS region, the third dimples may be arranged between two neighboring second dimples, the fourth dimples may be arranged around the third dimples, and the fourth dimples and the fifth dimples may be arranged around the fourth dimples.

The sizes of the second dimples, the third dimples, the fourth dimples, and the fifth dimples may be sequentially decreased, and respectively correspond to 97%, 94%, 88%, and 78% of the size of the first dimples. The first dimples, the second dimples, the third dimples, the fourth dimples, and the fifth dimples may have the same depth, or the first dimples, the second dimples, and the third dimples may have the same depth and fourth dimples and the fifth dimples may have the same depth corresponding to 98% of the depth of the first dimples.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
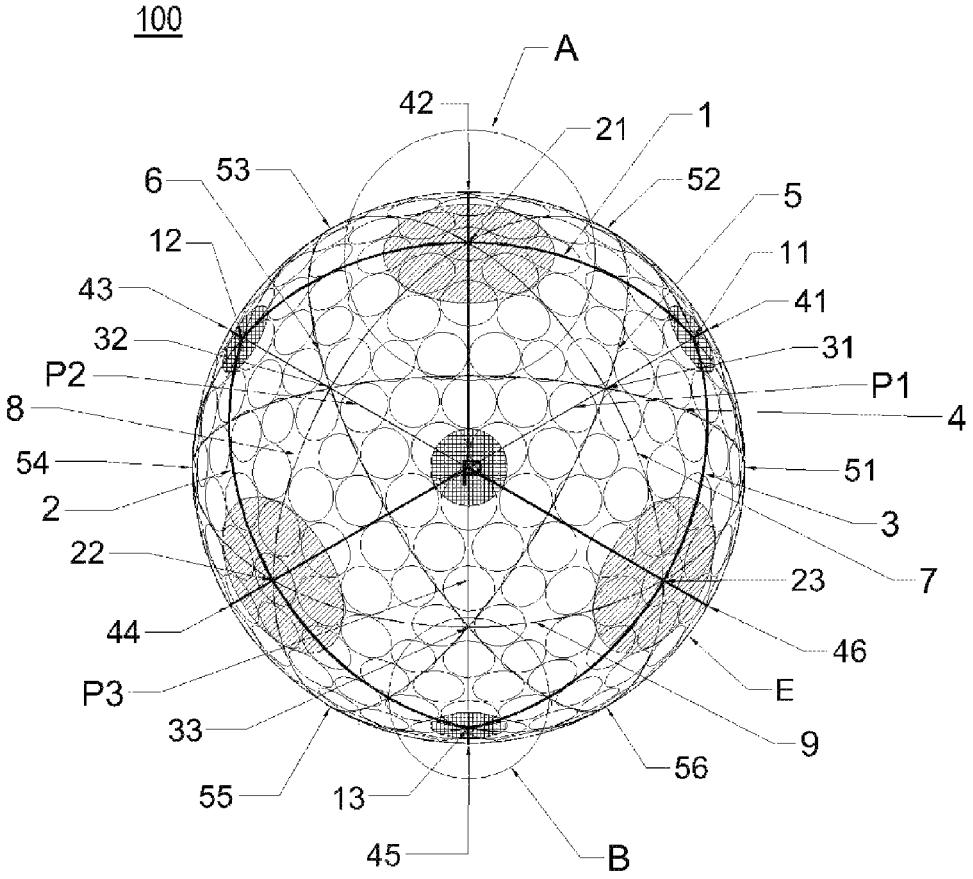
FIG. 1 is a view illustrating a dimple arrangement structure of a golf ball in accordance with the present invention

Reference will now be made in detail to the preferred embodiment of the present invention, examples of which are illustrated in the accompanying drawings. Those skilled in the art will appreciate that various modifications, additions, and substitutions to the specific elements are possible, without departing from the scope and spirit of the invention as disclosed in the accompanying claims. In the drawings, elements which do not relate to the prevent invention will be omitted, and the same or similar elements are denoted by the same reference numerals even though they are depicted in different drawings.

FIG. 1 is a view illustrating a dimple arrangement structure of a golf ball in accordance with one embodiment of the present invention.

As exemplarily shown in FIG. 1, a golf ball 100 in accordance with this embodiment of the present invention is configured such that a plurality of dimples is divisionally arranged on the outer surface of the golf ball 100, divided into a spherical polyhedron, by sizes so as to be suitable for divisional composition. Hereinafter, divisional composition and a dimple arrangement structure of the golf ball 100 will be described sequentially.

The surface of the golf ball 100 in accordance with this embodiment of the present invention is divided into a spherical rhombic dodecahedron consisting of spherical rhombi.

In more detail, if an arbitrary point P on the surface of a sphere is set as the pole (at a latitude of 90 degrees and a longitude of 90 degrees), and the surface of the sphere is divided by a great circle 1 passing through a point 51 (at a latitude of 0 degrees and a longitude of 0 degrees), a point 21 (at a latitude of 35.26438968982 degrees and a longitude of 90 degrees) and a point 54 (at a latitude of 0 degrees and a longitude of 180 degrees), a great circle 2 passing through a point 53 (at a latitude of 0 degrees and a longitude of 120 degrees), a point 22 (at a latitude of 35.26438968982 degrees and a longitude of 210 degrees) and a point 56 (at a latitude of 0 degrees and a longitude of 300 degrees), and a great circle 3 passing through a point 52 (at a latitude of 0 degrees and a longitude of 60 degrees), a point 23 (at a latitude of 35.26438968982 degrees and a longitude of 330 degrees) and a point 55 (at a latitude of 0 degrees and a longitude of 240 degrees), and the surface of the sphere is further divided by a great circle P1 passing through a point 41 (at a latitude of 0 degrees and a longitude of 30 degrees), the pole P and a point 44 (at a latitude of 0 degrees and a longitude of 210 degrees), a great circle P2 passing through a point 43 (at a latitude of 0 degrees and a longitude of 150 degrees), the pole P and a point 46 (at a latitude of 0 degrees and a longitude of 330 degrees), and a great circle P3 passing through a point 42 (at a latitude of 0 degrees and a longitude of 90 degrees), the pole P and a point 45 (at a latitude of 0 degrees and a longitude of 270 degrees), a spherical rhombic dodecahedron consisting of 12 spherical rhombi is formed.

In this case, a spherical triangle formed by interconnecting points, each where 3 spherical rhombi share one apex at the sides of the short diameter thereof jointly, is one great spherical triangle of a spherical tetrahedron surrounded with the great circle 1 passing through a point 11 (at a latitude of 19.47122028965 degrees and a longitude of 30 degrees) and a point 12 (at a latitude of 19.47122028965 degrees and a longitude of 150 degrees), the great circle 2 passing through the point 12 (at a latitude of 19.47122028965 degrees and a longitude of 150 degrees) and a point 13 (at a latitude of 19.47122028965 degrees and a longitude of 270 degrees), and the great circle 3 passing through the point 13 (at a latitude of 19.47122028965 degrees and a longitude of 270 degrees) and the point 11 (at a latitude of 19.47122028965 degrees and a longitude of 30 degrees).

Further, a point where 4 spherical triangles of a spherical octahedron formed by interconnecting points, each where 4 rhombi of the above-described spherical rhombic dodecahedron share one apex at the sides of the long diameter thereof jointly, i.e., of a spherical octahedron formed by dividing the surface of the sphere by a great circle 7 passing through the point 56 (at a latitude of 0 degrees and a longitude of 300 degrees), the point 31 (at a latitude of 54.7356098 degrees and a longitude of 30 degrees) and the point 53 (at a latitude of 0 degrees and a longitude of 120 degrees), a great circle 8 passing through the point 52 (at a latitude of 0 degrees and a longitude of 60 degrees), the point 32 (at a latitude of 54.7356098 degrees and a longitude of 150 degrees) and the point 55 (at a latitude of 0 degrees and a longitude of 240 degrees), and a great circle 9 passing through the point 54 (at a latitude of 0 degrees and a longitude of 180 degrees), the point 33 (at a latitude of 54.7356098 degrees and a longitude of 270 degrees) and the point 51 (at a latitude of 0 degrees and a longitude of 0 degrees), share one apex jointly exactly coincides with a point where 4 rhombi of the above-described spherical rhombic dodecahedron share one apex at the sides of the long diameter thereof jointly.

In addition, a spherical cube-octahedron is formed by the great circle 4, the great circle 5 and the great circle 6 interconnecting the neighboring midpoints of the respective sides of the respective spherical triangles of such a spherical octahedron, and a great circle (an equator line) E.

That is, in summary, the apex of the spherical rhombic dodecahedron at the side of the long diameter is the center of the spherical square of the spherical cube-octahedron and simultaneously, the apex of the spherical triangle of the spherical octahedron, and the apex of the spherical rhombic dodecahedron at the side of the short diameter is the center of the spherical triangle of the spherical cube-octahedron and simultaneously, the apex of the great spherical triangle of the spherical tetrahedron.

The surface areas of the respective spherical polygons formed by dividing the surface of the sphere in the above-described manner have been described above.

The divisional composition of the golf ball in accordance with this embodiment of the present invention has been described above. Hereinafter, dimples arranged according to the above-described divisional composition will be described in detail with reference to the accompanying drawings.

Figure 2:
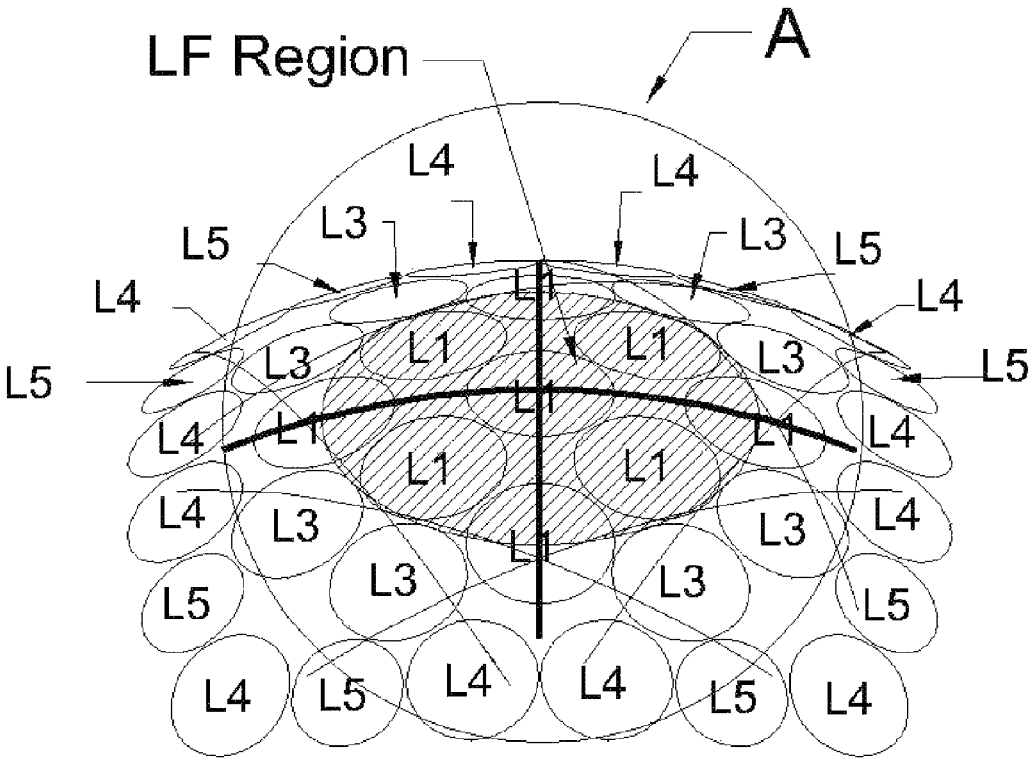
FIG. 2 is an enlarged view of the portion A of the golf ball shown in FIG. 1
Figure 3:
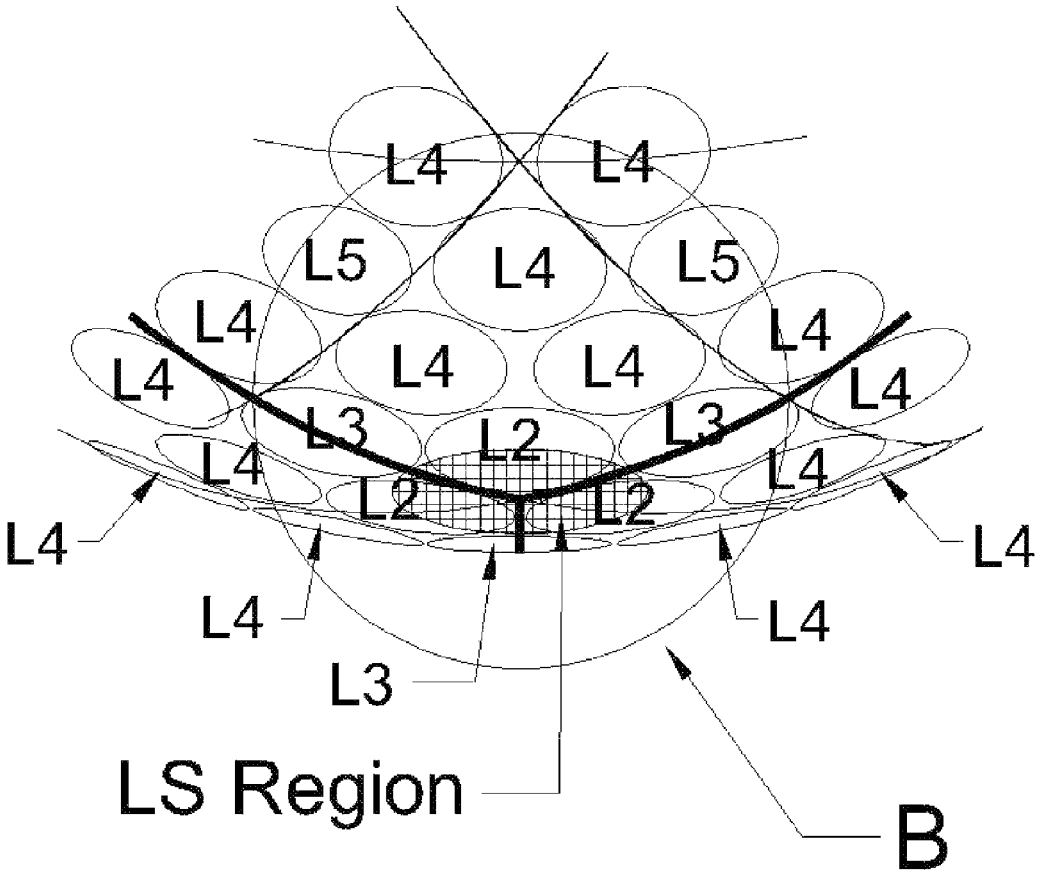
FIG. 3 is an enlarged view of the portion B of the golf ball shown in FIG. 1.

FIG. 2 is an enlarged view of the portion A of the golf ball shown in FIG. 1, and FIG. 3 is an enlarged view of the portion B of the golf ball shown in FIG. 1.

First, as exemplarily shown in FIG. 2, in order to balance pressure drag of the golf ball 100 flying while being rotated at a high speed, a circular LF region (a shaded region in FIG. 2) of a radius of π/10 radian±10% is set at the point where 4 rhombi of the spherical rhombic dodecahedron share one apex at the sides of the long diameter thereof jointly, and first dimples L1 having the largest diameter are arranged in the LF region.

In this case, the first dimples L1 are arranged so as to be bilaterally symmetrical. Here, all of the first dimples L1 may be arranged within the LF region, or some of the first dimples L1 may be arranged within the LF region and some of the first dimples L1 may be placed over the boundary line of the LF region such that almost half the first dimple L1 is arranged within the LF region. Other than second dimples L2 having the second largest diameter, third dimples L3 having the third largest diameter, fourth dimples L4 having the fourth largest diameter, and fifth dimples L5 having the fifth largest diameter may be arranged around the above-described first dimples L1 so as to be sequentially close to the first dimples L1.

Further, as exemplarily shown in FIG. 3, a circular LS region (a shaded region in FIG. 2) of a radius of π/20 radian±10% is set at the point where 3 rhombi of the spherical rhombic dodecahedron share one apex at the sides of the short diameter thereof jointly, and the second dimples L2 having the second largest diameter are arranged in the LS region.

In this case, the second dimples L2 are arranged such that the middle portion of the second dimple L2 corresponding to half the diameter of the second dimple L2 may be placed over the boundary line of the LS region. Around the second dimples L2, the third dimples L3 are arranged so as to be located between two neighboring second dimples L2, the fourth dimples L4 are arranged so as to surround the third dimples L3, and the fourth dimples L4 and the fifth dimples L5 are arranged so as to surround the fourth dimples L4. The fourth dimples L4 and the fifth dimples L5 arranged at the outermost region from the LS region overlap with the above-described outermost dimple arrangement of the LF region.

The sizes, i.e., the diameters, of the dimples used in the embodiment of the present invention will be described as follows. For example, if 5 kinds of dimples are used, the diameters of the first, second, third, fourth, and fifth dimples L1, L2, L3, L4, and L5 are restricted such that the diameter of the second dimples L2≥0.97L1 (the diameter of the first dimples L1), the diameter of the third dimples L3≥0.94L1 (the diameter of the first dimples L1), the diameter of the fourth dimples L4≥0.88L1 (the diameter of the first dimples L1), and the diameter of the fifth dimples L5≥0.78L1 (the diameter of the first dimples L1). Differently, if 4 kinds of dimples are used, the relations between first dimples L1 and second dimples L2 may be the same as the relations between 5 kinds of dimples are used. The reason of the case, as the proper dimple size according to the relations between sizes of the overall surface of the sphere occupied by the LF region and the LS region, the size of the second dimples L2 corresponding to 97% of the size of the first dimples L1 is advantageous for flying of the golf ball while balancing against air pressure.

Further, the depths of the dimples in accordance with this embodiment of the present invention may be formed as follows. That is, the first dimples L1, the second dimples L2, and the third dimples L3 may have the same depth of 0.0066~0.00665 inches and the fourth dimples L4 and the fifth dimples L5 may have the same depth of 98% of the depth of the first dimple L1, so that aerodynamic lift may be uniformized without a difference according to depths and a variable due to a difference with the depth of the first dimples L1 may be minimized.

As apparent from the above description, one embodiment of the present invention provides a golf ball in which regions having proper areas at respective positions are set so that pressure drag applied to spherical polygons having different surface areas during flying are balanced at a high-speed area up to the peak after striking of the golf ball using a golf club, and proper dimples are arranged according to the sizes of the regions so as to prevent shaking of a rotary axis throughout the overall surface area of the golf ball, thus balancing of pressure of air colliding with the golf ball to minimize a loss of aerodynamic lift and thereby raising the peak to improve a carry distance.

Although the preferred embodiment of the present invention has been disclosed for illustrative purposes, those skilled in the art will appreciate that various modifications, additions and substitutions are possible, without departing from the scope and spirit of the invention as disclosed in the accompanying claims. For example, the depths and diameters of the circular dimples in accordance with the embodiment of the present may be the same or different, as needed, and the embodiment of the present is not limited thereto.

Thus, it is intended that the present invention covers the modifications and variations of this invention provided they come within the scope of the appended claims and their equivalents.

What is claimed is:

1. A golf ball in which a plurality of dimples is arranged, comprising first dimples having a first diameter and second dimples having a second diameter arranged on a surface of the golf ball divided into a spherical rhombic dodecahedron, wherein the first dimples are arranged in a plurality of circular first regions, each circular first region of the plurality of circular first regions having a first radius of 5% of a circumference of the golf ball ±10% located on each first apex of a plurality of first apexes of the spherical rhombic dodecahedron, each first apex being shared jointly by 4 spherical rhombi of the spherical rhombic dodecahedron, and the second dimples are arranged in a plurality of circular second regions, each circular second region of the plurality of circular second regions having a second radius of 2.5% of the circumference of the golf ball ±10% located on each second apex of a plurality of second apexes of the spherical rhombic dodecahedron, each second apex being shared jointly by 3 spherical rhombi of the spherical rhombic dodecahedron.

2. The golf ball according to claim 1, wherein the first dimples are arranged within each first region, and the second dimples are arranged such that a middle portion of each second dimple corresponding to half the diameter of the second dimple is placed over a boundary line of each corresponding second region.

3. The golf ball according to claim 1, wherein some of the first dimples are arranged within each first region, and the remainder of the first dimples are arranged so as to be placed over a boundary line of each corresponding first region.

4. The golf ball according to claim 1, wherein third dimples having a third diameter, fourth dimples having a fourth diameter, and fifth dimples having a fifth diameter are sequentially arranged around each of the plurality of circular first regions in which the first dimples are arranged, wherein each size of the first, second, third, fourth, and the fifth diameter is different one another.

5. The golf ball according to claim 4, wherein the third dimples are arranged between two neighboring second dimples, the fourth dimples are arranged around the third dimples, and the fourth dimples and the fifth dimples are arranged around the fourth dimples.

6. The golf ball according to claim 5, wherein the sizes of the second dimples, the third dimples, the fourth dimples, and the fifth dimples are sequentially decreased, and respectively correspond to 97%, 94%, 88%, and 78% of the size of the first dimples.

7. The golf ball according to claim 5, wherein the first dimples, the second dimples, the third dimples, the fourth dimples, and the fifth dimples have the same depth.

8. The golf ball according to claim 5, wherein the first dimples, the second dimples, and the third dimples have the same depth, and fourth dimples and the fifth dimples have the same depth corresponding to 98% of the depth of the first dimples.

* * * * *